US005929374A

United States Patent [19]

Garland

[11] Patent Number: 5,929,374

[45] Date of Patent: Jul. 27, 1999

[54] ELECTRIC CABLE AND CONNECTOR SYSTEM

[76] Inventor: John W. Garland, 1150 E. Herndon, No. 101, Fresno, Calif. 93720

[21] Appl. No.: 08/887,399

[22] Filed: Jul. 2, 1997

[51] Int. Cl.[6] ..... H01B 7/04

[52] U.S. Cl. ..... 174/28; 174/111

[58] Field of Search ..... 174/111, 28, 26 R, 174/27, 29, 103, 105 B, 108; 333/243

[56] References Cited

U.S. PATENT DOCUMENTS

| | | | |
|---|---|---|---|
| 535,084 | 3/1895 | Stillwell et al. | 174/111 X |
| 1,667,510 | 4/1928 | Coe | 174/28 X |
| 1,818,027 | 8/1931 | Affel et al. | 174/28 |
| 2,105,060 | 1/1938 | Strom et al. | 174/111 X |
| 2,243,881 | 6/1941 | Peters et al. | 174/111 X |
| 2,351,520 | 6/1944 | Katzin et al. | 174/28 X |
| 2,438,347 | 3/1948 | Morin | 174/28 |
| 2,556,224 | 6/1951 | Scott | 174/28 X |
| 2,566,335 | 9/1951 | Joerren | 174/28 |
| 2,934,586 | 4/1960 | Gesell | 174/28 |
| 3,309,455 | 3/1967 | Mildner | 174/29 |
| 3,594,491 | 7/1971 | Zeidlhock | 174/36 |
| 3,594,492 | 7/1971 | Bahder | 174/36 |
| 3,831,636 | 8/1974 | Bittner | 174/108 X |
| 4,018,997 | 4/1977 | Herrmann, Jr. et al. | 174/29 X |
| 4,396,797 | 8/1983 | Sakuragi et al. | 174/111 X |
| 4,425,474 | 1/1984 | Durr | 174/110 F |
| 4,538,022 | 8/1985 | Barnicol-Ottler | 174/113 R |
| 4,538,023 | 8/1985 | Brisson | 174/115 |
| 4,628,151 | 12/1986 | Cardas | 174/114 R |

*Primary Examiner*—Kristine Kincaid
*Assistant Examiner*—Chau N. Nguyen
*Attorney, Agent, or Firm*—Mark D. Miller

[57] ABSTRACT

A multiple conductor electric and/or electro-optic cable is disclosed which has a series of integral insulation components (vertebrae) of a very low dielectric resulting in an excellent electron flow. The preferred embodiment includes multiple conductor assemblies each having an elongated cylinder, and each having a plurality of strands of electrical conducting material helically wound and longitudinally disposed between the ends of the cable. The innermost and outermost of such assemblies may serve as the anode. Helically wound in an axially opposing direction and lying between the two anode assemblies is the cathode. There may be as many as four layers of insulating vertebrae (typically made of balsa) each radially separating the conductor layers. The vertebrae may be of equal length and longitudinally aligned or displaced in a variety of configurations depending upon the application. The conductors terminate at connectors coupled to the cable itself by a low dielectric link. The entire length of the cable between the link and the connectors is enclosed by a single or multiple cylinders of materials which contribute to electromagnetic performance, provide mechanical strength and protection against the elements and which improve to the aesthetic appeal of the cable. This unique combination of extremely low dielectric materials allows the full signal of the source to travel almost unaltered through the cable.

4 Claims, 15 Drawing Sheets

ELECTRIC CABLE AND CONNECTOR SYSTEM

BACKGROUND OF THE INVENTION

1. Field of the Invention

The present invention relates to electric and/or electro-optic cable, and in particular to an advanced low-dielectric cable and connector system for use in a wide variety of applications from electro-optic micro fibers to telecommunications, computer, data transmission, audio, robotics, aerospace, marine and high voltage power cable. The novelties of this invention provide a wealth of benefits to all such cable types and their associated applications from both electromagnetic and mechanical perspectives.

2. Description of the Prior Art

Although this invention pertains to electric and electro-optic cable in general, it was developed as an advanced, low dielectric, extremely efficient audio cable and connector system for use in connecting electronic components in high fidelity applications.

The sophistication and overall quality of audio cable technology has progressed rapidly over the past twenty years and now stands as a dominant specialty of serious audio technology. Although the impact of audio cable on the overall quality of an audio system has been recognized since the inception of electronic high-fidelity equipment, the development of specialized audio cable for serious high-fidelity applications begin in the 1970's. Pioneered by Robert Fulton early audiophile cables improved sound quality by focusing on the materials used in the cable. The use of copper as a conductor and stranded wire are examples of such developments. Concentric conductor cables have long been used for transmission of sound and include dielectric washers between the concentric conductors made of rubber or glass as in U.S. Pat. No. 1,818,027 to Affel, et al. Helical polymer spacers have been used between olefin polymers to separate conductive layers as in U.S. Pat. No. 3,309,455 to Mildner. Fulton was one of the first to address the issue of frequency dependent signal timing by developing cable of specific lengths. This concern was further addressed by Brisson (U.S. Pat. No. 4,538,023) and Magnan (U.S. Pat. No. 4,767,890). Different sized conductors within a single cable have also been developed as in U.S. Pat. No. 4,628,151.

Subsequent developments in insulation material have significantly improved the quality of audio. Ordinary air, of course, has a highly desirable dielectric factor of 1.0. Teflon, with a dielectric factor of 2.1–2.3, became the industry standard in the 1980's. Developments regarding wire placement wrapping and coiling along with improvements in raw materials, such as oxygen-free copper (OFC) and high-purity silver (FPS) resulted in even better audio cable quality. As the sophistication of audio cable increased, the steps taken to address electromagnetic parameters associated with musical reproduction became more and more complex, such as the incorporation of resistors and capacitors into the cable itself.

However, all prior art high-fidelity cables are generally comprised of conductors insulated with a continuous segment of a hard material such as teflon, polystyrene, or polypropylene. The dielectric properties of these hard materials significantly restrict the natural flow of electrons and lack the dampening capabilities of the resonances associated with the natural vibrations of the signal conductors. As a result, the nuances of these vibrations smear, exaggerate and/or mask the delicate inner detail of the signal thus depriving the listener of the full sonic integrity and naturalness of the auditory experience being reproduced. Furthermore, although prior art cables have altered the electrical signal by modifying resistive, capacitive and inductive properties of the conductors and insulators, no prior art has used the natural electromagnetic forces inherent in such cable to actively reduce signal resonances.

Cables in the prior art have a much higher inductive reactance electromagnetic effect, selectively holding back current flow, and causing somewhat of a blurring (delay effect) of the sound. A significant part of this problem is from a much greater electron seepage through the insulator on cables in the prior art due to its higher dielectric factor.

To address these problems, the present invention uses an insulation material and overall structural design unique and novel to audio cable. The insulation material employed in this invention is balsa wood which has a very low dielectric factor of (1.4) which in itself causes very little electron seepage, through the balsa wood insulator, between the anode and cathode. This lack of seepage helps to lower the resistance. In addition, the dielectric factor is significantly lowered beyond the (1.4) dielectric factor due to the novel, very narrow line-contact of the conductor strands, with the balsa wood insulators. Although the wire conductors of the present invention are continuous for the entire length of the cable, the balsa insulation materials are arranged in a series of integral pieces, termed vertebrae, that are of equal length with air gaps between each one, thus providing: a means of breaking up any remaining resonances, cable mechanical flexibility, and a further reduction in the overall dielectric factor. Durr (U.S. Pat. No. 4,425,474) utilized wood pulp as a dielectric but it was a liquefied pulp material that fully enclosed the conductors. Thus, the overall dielectric factor of Durr is not nearly as low as the balsa vertebrae of the present invention, nor did it have the structural advantages or the low weight.

The mechanical benefits of a vertebrae configuration are a unique property of the present invention and represent a significant and novel technical development in the art. This distinctive vertebrae structure provides for exceptional cable strength, a major design characteristic for power and/or robotics cable. Edleen (U.S. Pat. No. 3,594,492) utilizes longitudinal or circumferential slits on cylindrical pipes that house conducting wire that are enclosed by an outer casing. Although such a structure improves mechanical strength, all conducting and insulating components are continuous for the length of the cable, unlike the present invention which utilizes vertebrae.

To further improve the mechanical strength of the cable, the present invention utilizes a guide wire at the center of the cable which may or may not be electrically active (depending on the application). Utilizing additional guide wires for purely structural and/or structural/electrical purposes at other locations within the cable is another characteristic of the present invention. Barnical-Oettler (U.S. Pat. No. 4,538,022) utilizes a dummy connector but it is enclosed by a soft elastomer material wrapped by an adhesive foil. Thus, any gain in reducing the overall dielectric and smearing effects as found in the present invention are lost. It is the unique combination of mechanical advantages of a vertebrae structure coupled with the electrical advantages of a vertebrae structure composed of a very light, low-dielectric compound in concert with a novel and unique arrangement of conducting and guide wires that results in the exceptional performance, both mechanical and electrical, of the present invention.

Also unique to the structure of the present cable is the placement of the cathode between two axially opposed anodes insulated by the balsa wood vertebrae. The line-contact is also broken up at the end of each vertebrae by air gaps which further lower the dielectric factor.

Collectively, inductive reactance is significantly lowered in the present invention by: the lowering of resistance due to the extremely low dielectric factor of the novel application of the insulator; the very low inductance; the lack of the proximity effect; the lack of the skin effect due to the small diameter of the strands, and the use of multiple strands of wire. This novel collection of unique applications improves the art by allowing the pure signal to pass through the cable unobscured of smearing caused by the higher inductive reactance of prior art cables. Furthermore, the higher the inductive reactance, the greater the tendency to fill in moments of signal silence with delayed sound that causes signal information similar to echoes, or blurring which detracts from the original intended sound or signal.

In addition, the lower inductive reactance results in the lowering of the overall electromagnetic force present within the cable which in return results in much lower internal resonances than in the prior art. The present structure serves to further reduce signal resonances by actively utilizing the electromagnetic forces generated within the cable by the oppositional placement of the cathode and anode.

Furthermore, this novel collection of unique characteristics dramatically improves the art by providing a significant improvement in electrical efficiency. This results in a cable with a very fast response time and low power consumption.

SUMMARY OF THE INVENTION

The present invention consists of an interior mechanical guide "wire" that can be a single wire composed of metal or other material or a group of typically twisted wires that run the length of the cable and has no other component interior to it. This mechanical guide "wire" can also be used as a conductor in certain applications or it may be omitted altogether. It is enclosed by a series of annular, interior vertebrae, each of equal length or of inconsistent, specified lengths arranged in a predetermined series (depending upon the application) and of equal diameter, composed of balsa wood, or of a variety of materials depending on the application. Unique to this invention is the usage of balsa wood as an insulator. Therefore, depending on the application, the vertebrae may be composed entirely of balsa wood or another material, utilize a surface casing balsa wood along the exterior and/or interior surface of the vertebrae.

The vertebrae are uniformly provided at spaced intervals along the length of the cable. Unique in this invention is the extremely low dielectric factor of the vertebrae. These interior vertebrae are separated from each other by a specified, distance of consistent or inconsistent length. The separation distance may be reduced to zero for certain applications. Furthermore it may or may not be filled with an adhesive compound (typically silicon) depending upon the cables' application. When applied, this adhesive serves to affix the vertebrae together and to the internal mechanical guide wire, while also adding structural support. Such spacing also serves to break up resonances and add flexibility.

Helically spiraled around the interior vertebrae is the interior anode made up of stranded wire. Unique to this invention, the molded adhesive compound between the interior vertebrae extends outward to only approximately 80% of the radial extent of the diameter of the interior vertebrae. Thus, the interior anode wrapped around the interior vertebrae never makes contact with the silicon compound therebetween.

The interior anode is enclosed by a series of secondary-level annular vertebrae, each of equal length or of inconsistent, specified lengths arranged in a predetermined series (depending on the application), of equal diameter, and also composed of balsa wood. These secondary-level vertebrae are also uniformly provided at regularly spaced intervals along the length of the cable, and provide an extremely low dielectric. The lengths of these secondary-level vertebrae may be equal to or different from the lengths of the vertebrae of the prior level. Indeed, unique to this invention is the distinctive arrangement of vertebrae from one level of vertebrae to the next as viewed from a radially outward direction from the center of the cable. By maintaining the lengths of the vertebrae constant from one level to the next, and by aligning the vertebrae longitudinally, the gap between the vertebrae would extend the entire diameter of the cable. Conversely, by having vertebrae of different lengths from level to level, or within the same level, and/or by displacing the longitudinal positions of the vertebrae, a staggered arrangement of vertebrae may be configured (like the staggering of bricks for a brick wall). Such a construction provides for great versatility for numerous mechanical attributes such as bending radii and stress and strain properties of the cable at large.

The secondary-level vertebrae are separated from each other by a specified distance of consistent or inconsistent length. Unique to this invention is the lack of adhesive compound within the gaps between the secondary-level vertebrae. Such spacing serves to break up resonances caused by signals passing through the conductors, lowers the dielectric factor, and also adds flexibility. These secondary-level vertebrae have a larger diameter than the interior vertebrae and thus enclose the interior vertebrae and anode wires.

Helically spiraled around the secondary-level vertebrae in a direction opposing the anode's spiral is the cathode comprised of stranded wire. The cathode is enclosed by annular, tertiary-level vertebrae, each of equal length or of inconsistent, specified lengths arranged in a predetermined series (depending on the application), and equal diameter composed of balsa wood or other material that run the length of the cable. The lengths of the tertiary-level vertebrae may be equal to or different from the lengths of the vertebrae of the prior level. Indeed, unique to this invention is the distinctive arrangement of vertebrae from one level of vertebrae to the next as viewed from a radially outward direction from the center of the cable. By maintaining the lengths of the vertebrae constant from one level to the next, and by aligning the vertebrae longitudinally, the gap between the vertebrae would extend the entire diameter of the cable. Conversely, by having vertebrae of different lengths from level to level, or within the same level, and/or by displacing the longitudinal positions of the vertebrae, a staggered arrangement of vertebrae may be configured (like the staggering of bricks for a brick wall). Such a construction provides for great versatility for numerous mechanical attributes such as bending radii and stress and strain properties of the cable at large.

The tertiary-level vertebrae are (axially) aligned with the secondary-level (and the interior) vertebrae. Again, unique to the invention is the extremely low dielectric factor of the vertebrae. Each of these vertebrae is separated from the next by a specified, distance of consistent or inconsistent length. Unique to this invention is the lack of adhesive compound between the gaps of the tertiary-level vertebrae. Such spacing also serves to break up resonances, caused by signals passing through the conductors, lower the dielectric factor, and add flexibility. The tertiary-level vertebrae have a larger diameter than the secondary-level vertebrae and thus enclose the secondary-level vertebrae and cathode wires.

Helically spiraled in a direction opposing the cathode's spiral around the tertiary-level vertebrae is the exterior anode comprised of stranded wire. Unique in this invention is the placement of the cathode between the inner and outer anodes. This creates a magnetic field that dampens, by electromagnetic force, the resonances caused by the electrical signal. Since there is no adhesive compound extending to the cathode or either the inner or outer anodes, the only insulating materials in contact with the cathode and interior and exterior anodes are the balsa wood and air. Thus, the dielectric factor is extremely low. Very unique to this invention is that due to the narrow line contact of any wire (sandwiched between the balsa wood vertebrae) and the air spaces between the vertebrae, the actual dielectric factor is significantly lower than the 1.4 dielectric factor of the balsa wood vertebrae.

The exterior anode is enclosed by annular, exterior vertebrae, each of equal length or of inconsistent, specified lengths arranged in a predetermined series (depending on the application) and equal diameter and composed of balsa wood or other material that run the length of the cable. They may be equal to or different from the lengths of the vertebrae of the prior level. As with previous vertebrae, a distinctive arrangement of vertebrae is possible from one level of vertebrae to the next as viewed from a radially outward direction from the center of the cable. By maintaining the lengths of the vertebrae constant from one level to the next, and by aligning the vertebrae longitudinally, the gap between the vertebrae would extend the entire diameter of the cable. Conversely, by having vertebrae of different lengths from level to level, or within the same level, and/or by displacing the longitudinal positions of the vertebrae, a staggered arrangement of vertebrae may be configured (like the staggering of bricks for a brick wall). Such a construction provides for great versatility for numerous mechanical attributes such as bending radii and stress and strain properties of the cable at large. This configuration further increases the strength of the cable, as does the internal mechanical guide wire. Each of these vertebrae is separated from the next by a specified, distance of consistent or inconsistent length. There is a lack of adhesive compound within the gaps between the exterior vertebrae, which are made of low dielectric balsa wood. Such spacing also serves to break up resonances, caused by signals passing through the conductors, lowers the dielectric factor, and also adds flexibility. The exterior vertebrae have a larger diameter than the tertiary-level vertebrae and thus enclose the tertiary-level vertebrae and the exterior anode wire.

The exterior vertebrae are enclosed by an exterior absorption casing (typically a molded layer of silicon). Unique to this invention is that remaining internal resonances are absorbed by this exterior absorption casing.

Exterior to this absorption casing lie the exterior casings. The type of material used and the number of exterior casings employed depends on the application. Such casing may vary from a single casing composed of a simple nylon mesh (as would be used in audio cable designed for indoor, home use) to a series of casings composed of impact and corrosion resistant thermoplastic resin compounds integrated with metal compounds with high structural strength characteristics (as would be used in outdoor or marine environments where the cable could be subjected to high mechanical stress). Again, unique to this invention is the lack of contact between high dielectric insulating material (such as the exterior absorption casing) and conductors (such as the interior and exterior anodes and the cathode). Thus the structural functions of the exterior absorption casing or the adhesive compound affixed to the interior vertebrae and mechanical guide wire, do not compromise the electron flow and corresponding electromagnetic interaction between the cathode and interior and exterior anodes.

At each end of the cable are the cable links which serve as a bridge to connect the anode and cathode to a variety of standardized or novel electrical and/or electro-optic connectors. In addition, the links serve as a means to mechanically terminate and stabilize the cable. Since the variety of connectors in the art is extensive, specifying a particular arrangement for the link is not practical. The purpose of the link is to maintain the performance benefits unique to this invention while providing a means to make a practical connection to connection components common to the art (such as plugs, jacks and spades). To that end, the interior portion of the link could be composed of balsa wood arranged in such a way that the wires passing through the link are sufficiently isolated from each other as is required for the application involved. In accord with the spirit of the invention, use of adhesive material is kept to a minimum and for the most part balsa wood and air are the only compounds touching the wires. Thus, the low dielectric inherent of the cable proper is maintained.

Lying exterior to the interior portion of the link is the exterior link casing. Such material may vary depending on the application involved (ranging from a PVC-type casing for data transmission applications to corrosive resistant thermoplastic resin compounds for marine applications). Unique to this invention is the use of hardwoods (such as cocobolo, ebony, tulipwood, rosewood, mahogany, maple or other hardwoods) as an exterior link casing material for cable designed for indoor use. The dielectric of hardwoods as a class is very low, although not as low as balsa. This in turn maintains a high overall efficiency which results in the cable's low power consumption and high speed characteristics. The placement of the hardwood material, with its relatively low dielectric, exterior to the balsa wood interior material help to eliminate unwanted resonances and differential impedances caused by dissimilar metals such as the standard brass covers typically used in conjunction with copper connectors. Furthermore, the aesthetic appeal of hardwoods makes its use in electric and/or electro-optic cable a novel feature; one that is quite distinctive and appealing in the audiophile market.

The diversity of cable types which could utilize the novel attributes of the present invention include electro-optical micro fibers, telecommunications, computer, audio, robotics, aerospace, marine, and high voltage power cable. In addition, electromagnetic devices such as printed circuit boards, electrical connectors and switches could also benefit from the unique attributes of the present invention.

It is therefore a primary object of the present invention to provide a high fidelity electrical cable and connection system having reduced the following: inductive reactance; capacitance; inductance; mechanical resonances caused by electrical current that causes resonances thereby producing blurring; and a greatly reduced dielectric which reduces electron seepage, all in order to provide a more efficient, accurate and faster transmission of electronic signals.

It is also a primary object of the present invention to provide faster, more efficient and accurate transmission of electronic signals using a high fidelity electrical cable and connection system having a greatly reduced overall dielectric, with reduced inductive reactance, reduced capacitance, reduced inductance, reduced mechanical resonances caused by electrical current (blurring), and reduced electron seepage.

It is a further important object of the present invention to provide an electronic cable having the cathode placed between inner and outer anodes, separated therefrom by a series of uniformly spaced annular balsa wood washers thereby providing a magnetic field that dampens, by electromagnetic force, the resonances caused by the electrical signal while also providing a greatly reduced overall dielectric.

It is a another object of the present invention to provide a coupling system for cable of the type describe herein that utilizes low dielectric balsa and/or hardwoods for attachment to the unique dual anodes and single cathode of the cable itself.

It is another object of the present invention to provide a conductive cable having a series of non-continuous longitudinal annular mechanical support vertebrae made of balsa wood or other material for separation of the conductive elements of the cable.

It is another object of the present invention to provide a conductive cable having a single cathode placed between an inner and an outer anode, the cathode separated from the anodes by a series of uniformly spaced annular balsa wood or other material vertebrae with air gaps between them.

It is another object of the present invention to provide a conductive cable having a series of non-continuous longitudinal annular mechanical support vertebrae for separation of the conductive elements of the cable in which successive vertebrae layers may be longitudinally or radially displaced or arranged to provide additional mechanical, electromagnetic or electro-optical features.

It is another object of the present invention to provide a conductive cable having a series of non-continuous longitudinal annular mechanical support vertebrae for separation of the conductive elements of the cable in a non-continuous, radially and longitudinally positioned, hard exterior and soft interior insulation compound structure.

It is another object of the present invention to provide a conductive cable having a series of non-continuous longitudinal annular mechanical support vertebrae for separation of the conductive elements of the cable which contributes to high electrical current conducting efficiency, fast electrical response time, and which is especially suited for computer and telecommunication applications.

It is another object of the present invention to provide a conductive cable having a series of non-continuous longitudinal annular mechanical support vertebrae for separation of the conductive elements of the cable which provides for a mechanism for interferometric applications, cavity length applications, and differential refractive or reflective indices applications in electro-optical usage.

It is another object of the present invention to provide a conductive cable having a series of non-continuous longitudinal annular mechanical support vertebrae for separation of the conductive elements of the cable which contributes to fast electrical current response time.

It is another object of the present invention to provide a conductive cable having a series of non-continuous longitudinal annular mechanical support vertebrae for separation of the conductive elements of the cable where the cathode is placed between inner and outer anodes to specifically utilize the resulting magnetic field to contribute to reducing electrical current conducting resonances, improving electric current conduction efficiency, reducing overall capacitance and reducing overall inductance of the entire cable.

It is another object of the present invention to provide a conductive cable having a series of non-continuous longitudinal annular mechanical support vertebrae for separation of the conductive elements of the cable that are made of balsa wood which has a low dielectric, is lightweight, is easy to fabricate and which contributes to high electrical current conducting efficiency.

It is another object of the present invention to provide a conductive cable having a series of non-continuous longitudinal annular mechanical support vertebrae for separation of the conductive elements of the cable attached to a hardwood coupling link utilizing balsa and/or hardwood compounds that result in a low dielectric and which contributes to high electrical current conducting efficiency of the overall cable.

It is another object of the present invention to provide a cosmetically pleasing conductive cable having a series of non-continuous longitudinal annular balsa wood mechanical support vertebrae for separation of the conductive elements of the cable attached to a hardwood coupling link such that only wood and air are the insulating material.

It is another object of the present invention to provide a cable of the type described herein that is especially suited for robotic, marine, power transmission, aeronautical and aerospace applications.

Other objects of the invention will be apparent from the detailed descriptions and the claims herein.

DETAILED DESCRIPTION OF THE DRAWINGS

Figure 1:
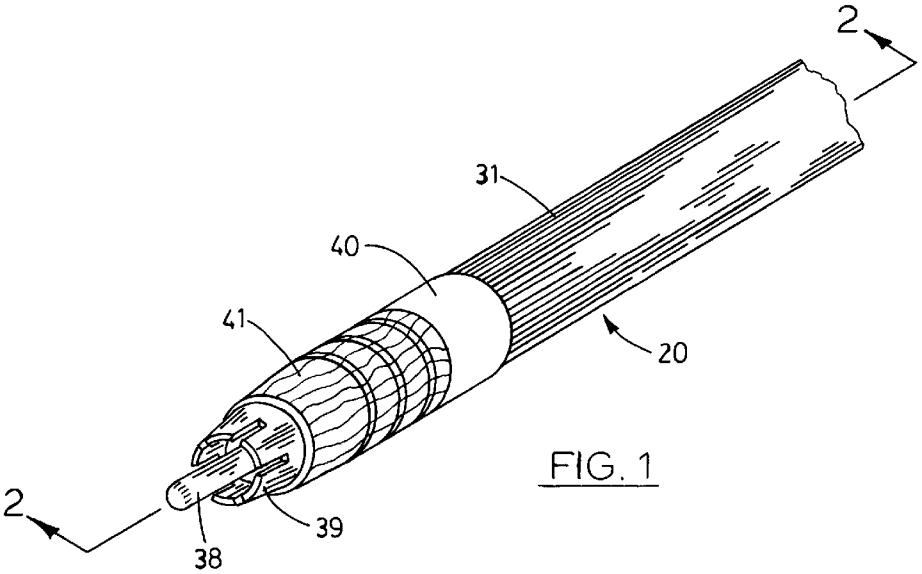
FIG. 1 is a perspective external view of a single conductor anode and single conductor cathode version of the cable of the present invention.

Referring to the drawings wherein like reference characters designate like or corresponding parts throughout the several views, and referring particularly to FIGS. 1–4 and 11, it is seen that the invention includes a single cable assembly generally 20 having a central twisted mechanical guide wire 21 surrounded by a series of internal cylindrical segments or vertebrae 22. Guide wire 21 is threaded through a cylindrical channel positioned in the center of each interior vertebrae 22. The interior vertebrae 22 are fabricated from balsa wood or other material and are longitudinally positioned between the ends of the mechanical guide wire 21. Each of the interior vertebrae 22 are of approximately equal length and diameter, and are separated by longitudinal gaps 23 of approximately equal length between each vertebrae. Depending on the application, gaps 23 may be partially filled with a self-curing, non-conductive flexible silicon or other similar compound 37. Compound 37 surrounds guide wire 21 in gaps 23, but does not fully extend to the outer diametric edge of adjacent internal vertebrae 22. It should be noted that in some cable applications, all or any combination of gaps 23, 26 and 29 may be eliminated such that adjacent vertebrae may touch against each other without any gaps (FIG. 2D).

Unique to this invention is the utilization of balsa wood which has an extremely low dielectric factor yet is stiff and provides flexibility by the continuous, longitudinal assembly of component vertebrae, with a specified uniform gap between each, the summary of which determines the length of the cable.

The cathode 24 is comprised of strands of wire that is helically wound around the internal vertebrae 22. Surrounding the cathode 24 are secondary-level vertebrae 25 which are also fabricated from balsa wood or other material. Each of the secondary-level vertebrae 25 may be of approximately equal length and diameter, and may include an internal cylindrical channel designed to accommodate cathode 24 and the interior vertebrae 22. Between vertebrae 25 may be gaps 26 of approximately equal length which separate vertebrae 25 from each other. It is to be noted that no flexible material is provided in gaps 26 between the secondary-level vertebrae 25. The length of the secondary-level vertebrae 25 may be approximately equal to that of the interior vertebrae 22, and they may be positioned to be longitudinally aligned with the interior vertebrae 22 (see FIGS. 2, 2A and 2B). It should be noted that vertebrae 25 may be of different lengths than interior vertebrae 22, and they may be positioned differently, depending upon the desired resonances and flexibility of the ultimate cable.

Anode 27 is comprised of strands of wire that is helically wound around the secondary-level vertebrae 25. Surrounding the anode 27 are outer vertebrae 28 which are also fabricated from balsa wood. Each outer vertebrae 28 may be of approximately equal length and diameter, and designed to accommodate the secondary-level vertebrae 25 and anode assembly. Vertebrae 28 are separated from each other by gaps 29 which may be of approximately equal length. Again, no flexible material is provided in gaps 29. The length of the vertebrae 28 may be approximately equal to that of the secondary-level 25 (and thus interior 22) vertebrae. The outer vertebrae 28 may be positioned to be longitudinally displaced by ½ the length of the vertebrae 28 relative to the secondary-level vertebrae 25 (see FIGS. 2, 2A and 2B). Accordingly, gaps 23 and 26 would be aligned with each other, while gaps 29 would not. It should be noted that vertebrae 28 may be of different lengths than that of secondary-level vertebrae 25 (or interior vertebrae 22), and they may be positioned differently, depending upon the desired resonances and flexibility of the ultimate cable.

Surrounding the exterior vertebrae 28 is a cast and cured continuous cylinder 30 made of flexible silicon or other similar material which does not come into contact with any conductor in cable 20. Cylinder 30 serves to absorb such internal resonances from the internal assemblies which are caused by the passing of electrons through the conductors. However, novel to this invention is the effect of a very low resonance due to the extremely low inductive reactance of the cable. Encasing cylinder 30 is a continuous cylindrical casing 31 of flexible nylon or other mesh which serves as a protective covering for the entire length of the vertebrae assembly.

Figure 2:
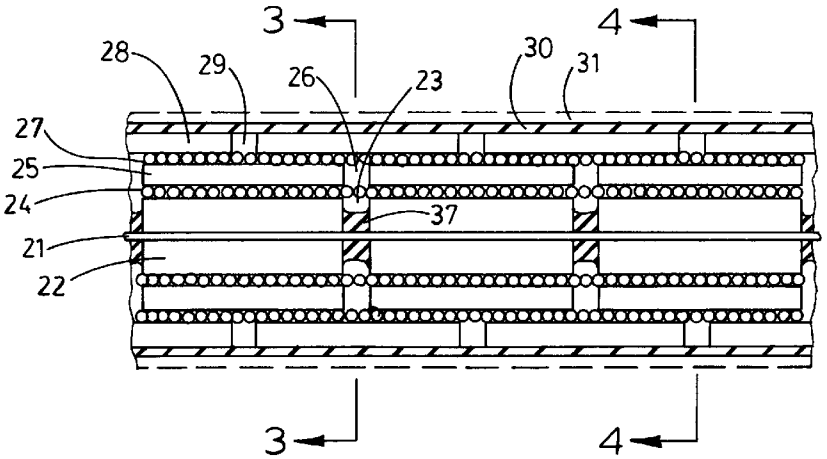
FIG. 2 is a cross-sectional view along part of line 2—2 of FIG. 1 showing the internal components of the cable of FIG. 1.
Figure 2A:
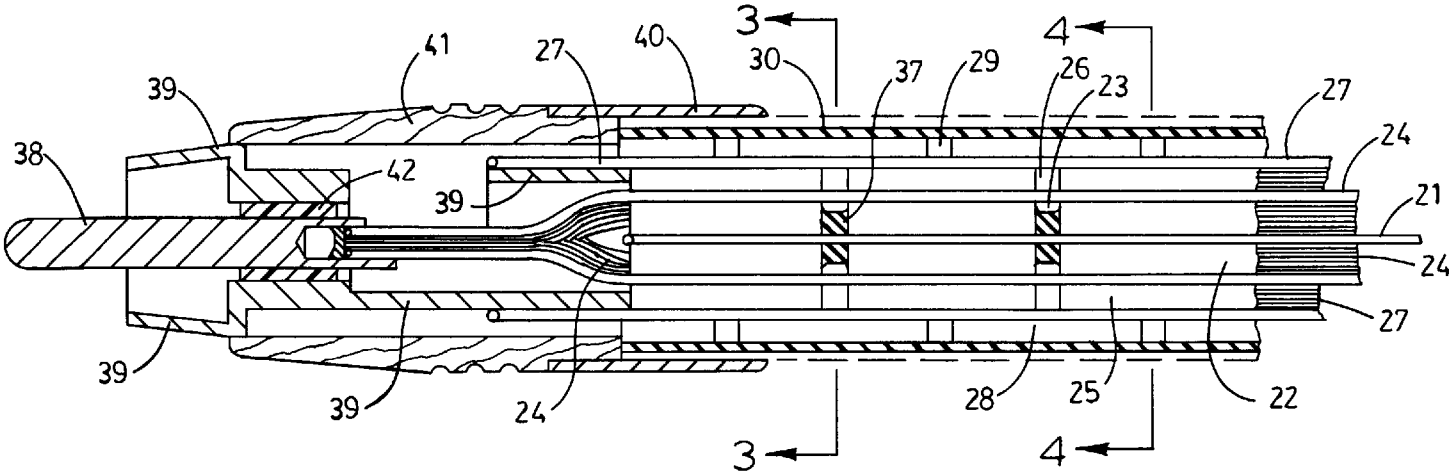
FIG. 2A is a cross-sectional view along line 2—2 of FIG. 1 showing the internal components of the cable and connector of FIG. 1.
Figure 2C:
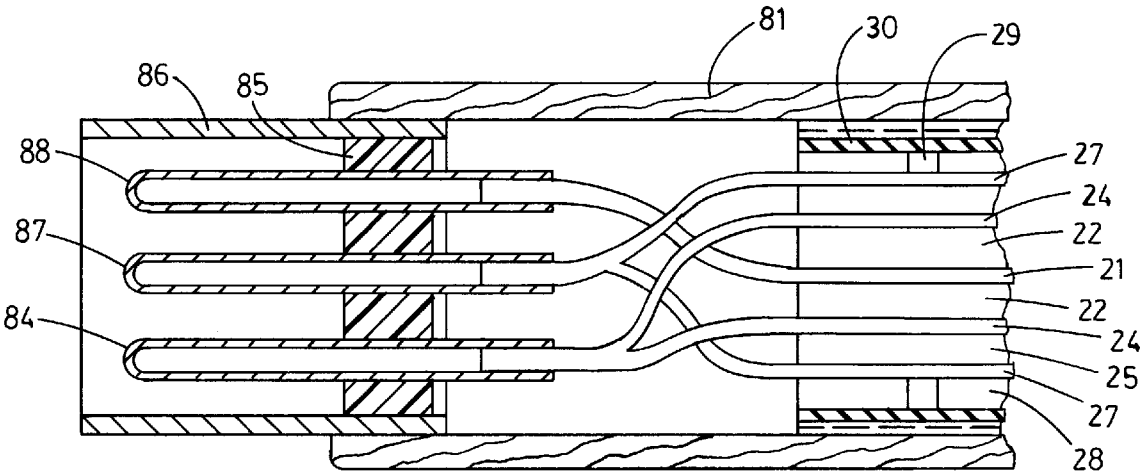
FIG. 2C is a cross-sectional view of an alternative embodiment of a balanced line connector configuration of FIG. 2A.

Referring specifically to FIG. 2A, it is seen that a novel hardwood audio cable adaptor 41 may be attached to cable 20 (see FIG. 1). Using such an adaptor, cathode wires 24 are conductively associated with a metallic central prong 38, and anode wires 27 are conductively associated with a metallic cylindrical piece 39 on adaptor 41. Prong 38 and piece 39 are separated by insulator 42 to prevent shorting. Strip 40 holds adaptor 41 to cable 20 (see FIG. 1).

Figure 2B:
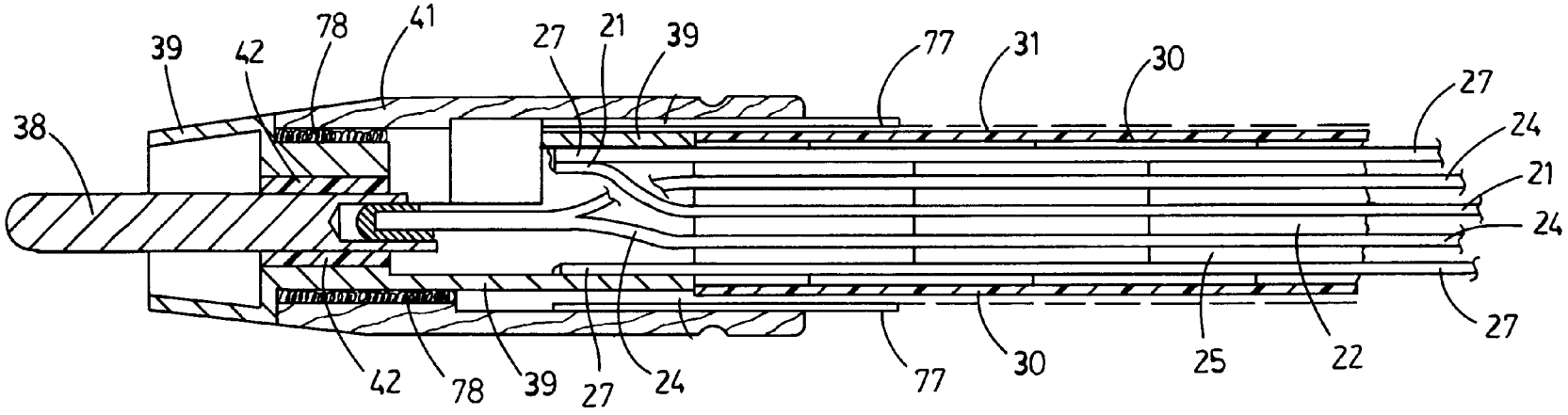
FIG. 2B is a cross-sectional view of an alternative embodiment of a connector configuration of FIG. 2A showing the interior and exterior anode legs.
Figure 2D:
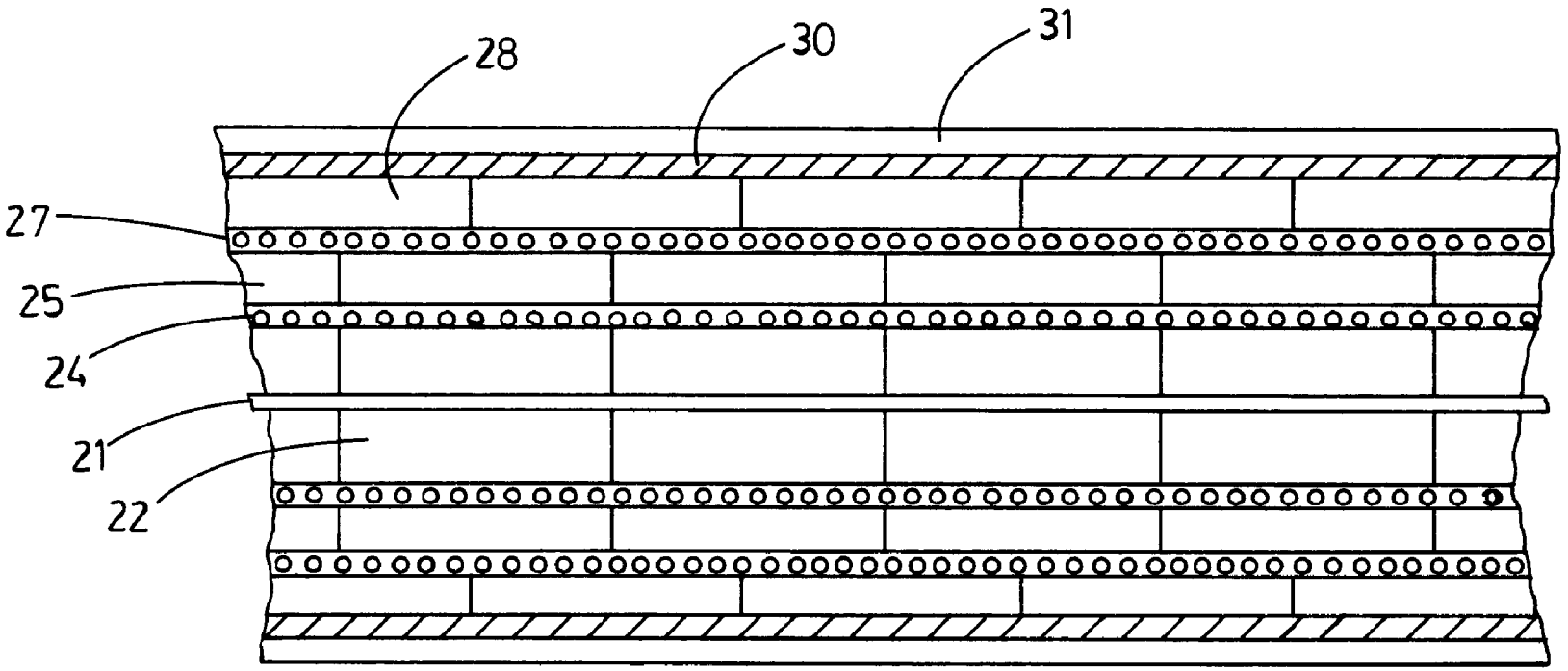
FIG. 2D is a cross-sectional view of an alternative embodiment along part of line 2—2 of FIG. 1 showing the internal components of an alternative embodiment of the cable of FIG. 1.
Figure 4:
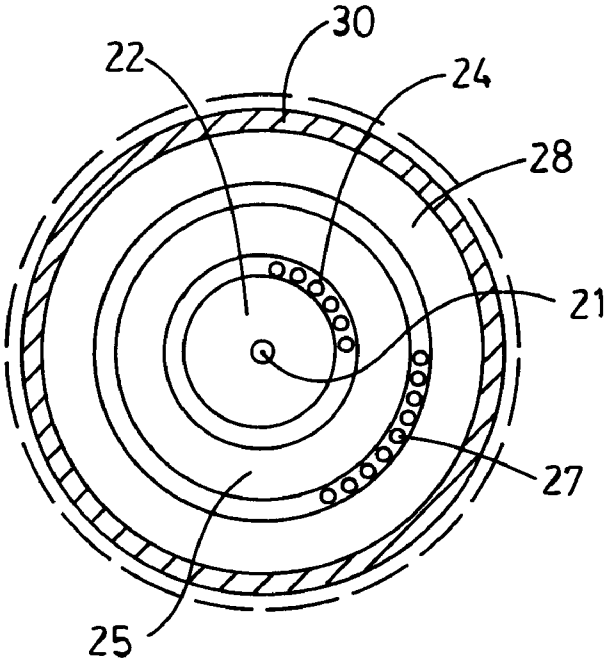
FIG. 4 is a cross-sectional view along line 4—4 of FIG. 2 at a gap between outer vertebrae.
Figure 3:
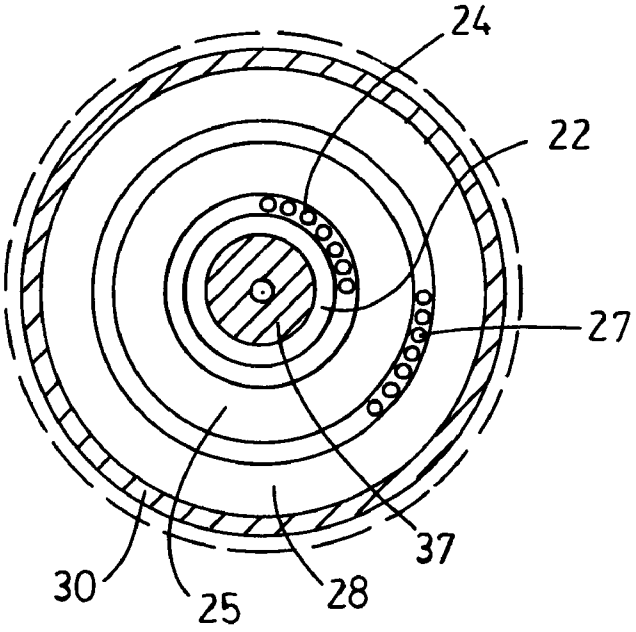
FIG. 3 is a cross-sectional view along line 3—3 of FIG. 2 at a gap between inner vertebrae.
Figure 5:
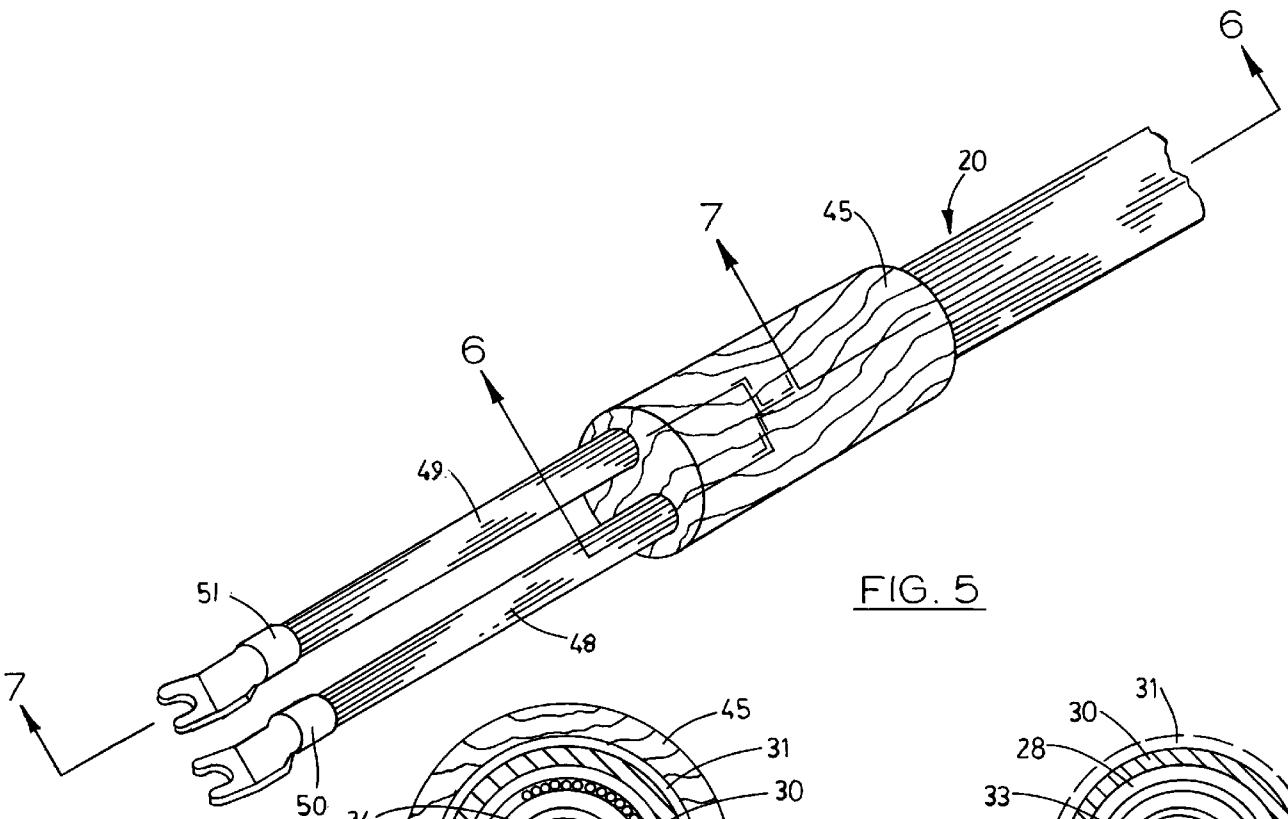
FIG. 5 is a perspective view of a cable of the present invention connected to the hardwood link that couples the connector with the cable itself.
Figure 9:
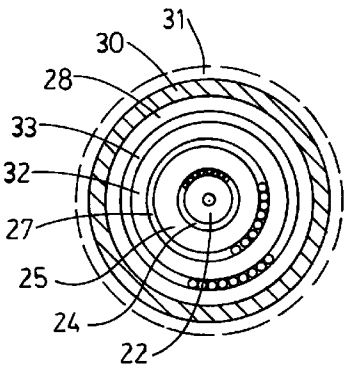
FIG. 9 is a cross-sectional view along line 9—9 of FIG. 6 at a gap between outer vertebrae.
Figure 8:
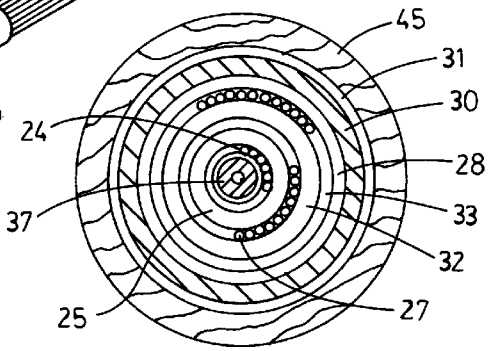
FIG. 8 is a cross-sectional view along line 8—8 of FIG. 6 at a gap between inner vertebrae.
Figure 6:
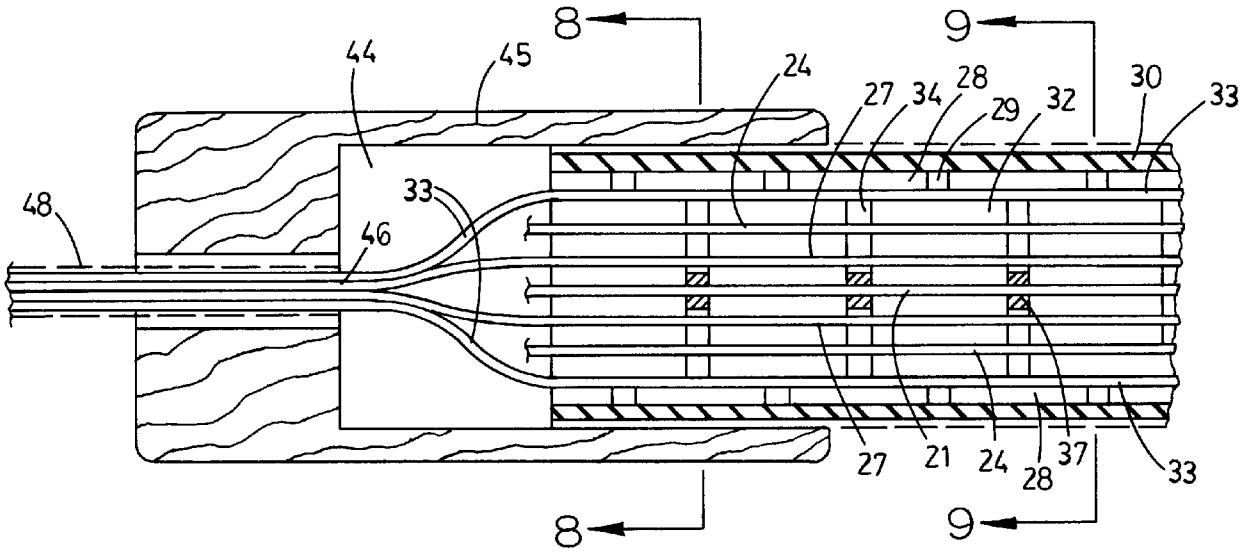
FIG. 6 is a cross-sectional view along line 6—6 of FIG. 5 showing the hardwood link, the interior and exterior anode legs, vertebrae, and conductors.
Figure 7:
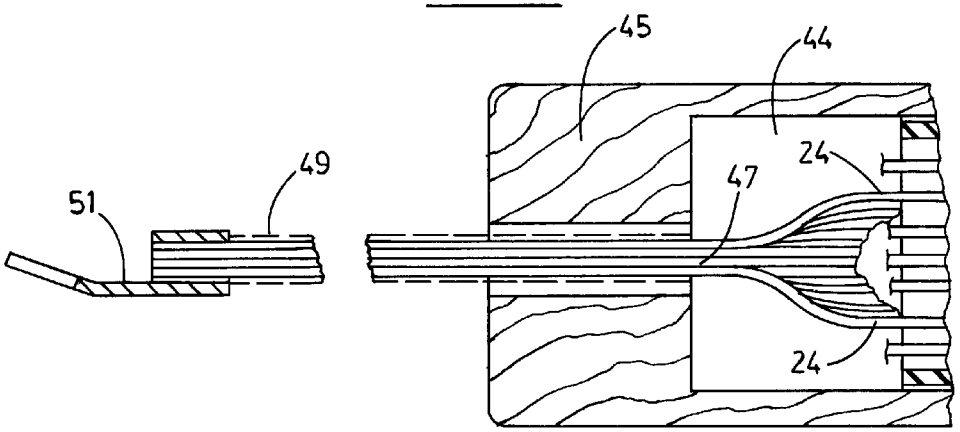
FIG. 7 is a cross-sectional view along line 7—7 of FIG. 5 showing the hardwood link, the cathode leg, and connector.

Referring specifically to FIG. 2B, it is seen that the guide wire 21 and anode wires 27 are conductively associated with a metallic cylindrical piece 39 on adaptor 41. Prong 38 and piece 39 are separated by insulator 42 to prevent shorting. A cylindrical metal sleeve 77 is provided between casing 31 and hardwood adaptor 41. Epoxy 78 holds adaptor 41 to piece 39.

Referring specifically to FIG. 2C, an alternate use of cable 20 is disclosed for a "balanced line" electronic application. It is seen that a novel hardwood audio adaptor 81 may be attached to cable 20. Using such an adaptor, cathode wires 24 are conductively associated with a metallic prong 84, anode wires 27 are conductively associated with a metallic prong 87, and guide wire 21 is conductively associated with a metallic prong 88. Prongs 84, 87 and 88 are separated by insulator 85 which is contained in housing 86.

In the alternative embodiment shown in FIGS. 5–9 and 12, an additional set of tertiary-level vertebrae 32 and an additional (dual conductor) anode wire 33 are provided. It should be noted that this alternative embodiment is different from the single cable assembly in FIGS. 1–4 and 11 in that the cathode 24 and the anode 27 in FIGS. 1–4 and 11 are alternately reversed with the interior anode 27 and the cathode 24 in the alternative embodiment shown in FIGS. 5–9 and 12. Vertebrae 32 are made of balsa wood or other material and surround cathode 24. Each of the tertiary-level vertebrae 32 may be of approximately equal length and diameter, and include an internal cylindrical channel designed to accommodate cathode 24 and vertebrae 25. Between vertebrae 32 are gaps 34 that may be of approximately equal length which separate vertebrae 32 from each other. It is to be noted that no flexible material is provided in gaps 34 between the tertiary-level vertebrae 32. The length of the tertiary-level vertebrae 32 may be approximately equal to that of the secondary-level vertebrae 25, and they are positioned to be longitudinally aligned with the secondary-level vertebrae 25 (see FIG. 6). It should be noted that vertebrae 32 may be of different lengths than that of secondary-level vertebrae 25 (or interior vertebrae 22), and they may be positioned differently, depending upon the desired resonances and flexibility of the ultimate cable.

Dual conductor anode 33 is comprised of strands of wire that is helically wound around the tertiary-level vertebrae 32. Outer vertebrae 28 are then provided surrounding anode 33, using positioning that may be offset from the internal, secondary-level, and tertiary-level vertebrae, as previously described.

At each end of cable 20, the plurality of wires of the external anode 33 and the interior anode 27 are twisted together at 46 beginning at the outside ends of the vertebrae and continuing outward to the end of the anode. Dual anode 46 is then passed through a first large internal cylindrical channel 44 in hardwood link 45, through an exit opening at one side and into a nylon or other mesh casing 48. The ends of the twisted anodes 46 are left exposed for insertion into connector 50 which is crimped and soldered.

Similarly, the plurality of wires of the cathode 24 are twisted together at 47 beginning at the outside ends of the vertebrae and continuing outward to the end of the cathode. Cathode 47 is then passed through the large internal cylindrical channel 44 in hardwood link 45, through an exit opening at the opposite side from the anode, and into a nylon or other mesh casing 49. The ends of the twisted cathodes 47 are left exposed for insertion into connector 51 which is crimped and soldered.

Figure 13:
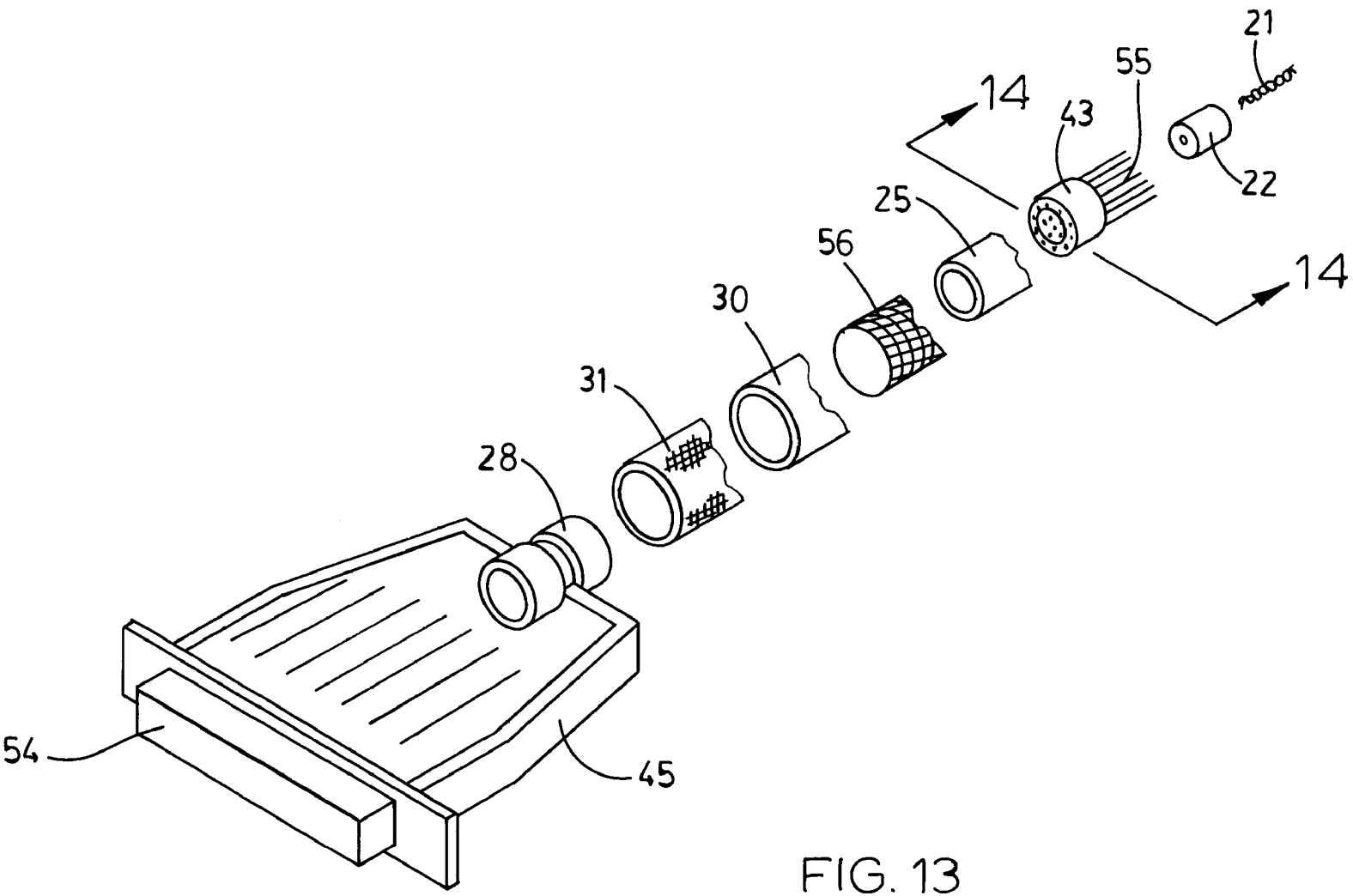
FIG. 13 is an exploded view of a cable of the present invention adapted for use with a computer, or similar data transmission applications.

The specification as set forth above describes the specifics of the invention as it would pertain to usage as an audio cable. However, the many novel features of the invention are readily extended to cable for use in other fields. One application of the present invention is use as a cable to connect data processing components. FIG. 13 shows such an example where the cable depicted is a parallel port, computer-to-printer connector 54. At the center of the cable lies the guide wire 21 and interior vertebrae 22, as found in the audio cable example. Exterior to the interior vertebrae lie the numerous data wires 55 (typically a fine wire gauge). These wires 55 are fed into the wire dielectric guide 43 which is inserted through the secondary-level vertebrae 25. An electrical shield 56 is also provided.

Figure 14B:
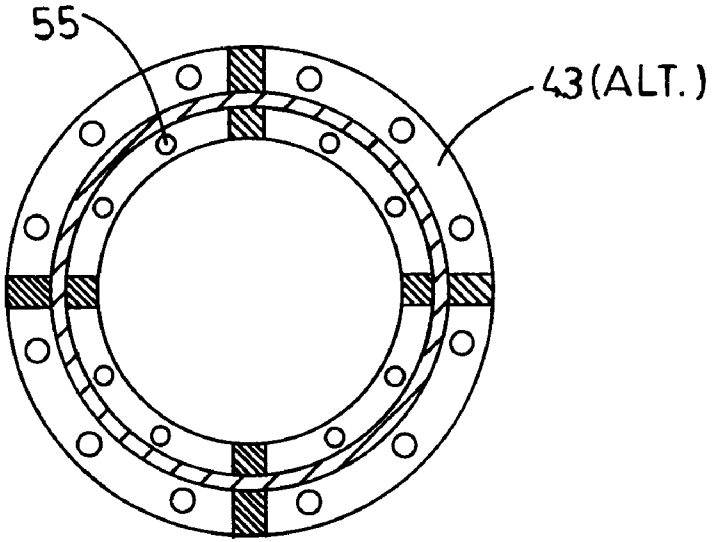
FIG. 14B is a cross-sectional view of the interior of a cable of the present invention along line 14—14 of FIG. 13 depicting an alternative vertebrae configuration typical of data transmission applications.
Figure 14A:
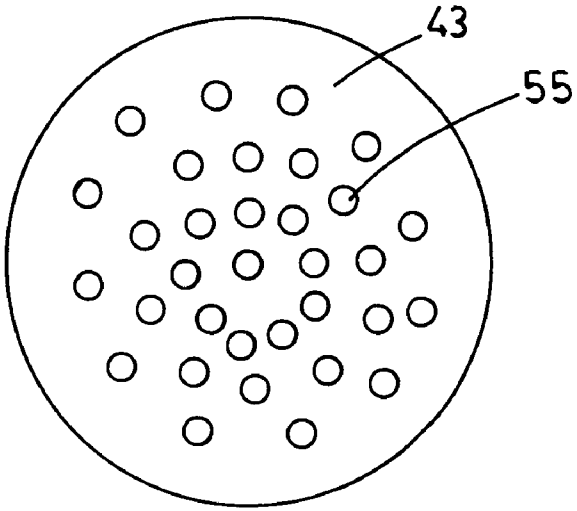
FIG. 14A is a cross-sectional view of the interior of a cable of the present invention along line 14—14 of FIG. 13.

FIG. 14A shows a cross-section of the cable showing how the wires 55 in wire dielectric guide 43 could be supported by the secondary-level vertebrae. FIG. 14A shows a spiral pattern where each individual wire has its own micro channel through which it passes. FIG. 14B shows an alternate structure that utilizes additional levels of vertebrae. The exact arrangement of the data wires would be based on their electrical signal characteristics and they could be twisted together and/or specifically ordered within the secondary-level vertebrae to promote efficiency, signal quality and clarity.

Exterior to the secondary-level vertebrae 25 lies the coiled shielding wire 56 (typically wrapped in foil as a Faraday shield—see FIG. 13). Exterior to this wire are the exterior vertebrae 28, similar to the audio cable example. Following this are the absorption 30 and exterior 31 casings. The exterior casing could be composed of a PVC type material as is typical for such data communication cable.

At the ends of the cable lie the cable links 45. As with the audio cable example, the interior portion of the link would be constructed of balsa wood and arranged in manner to provide passage for the data wires in a manner consistent with the optimum arrangement set forth by the secondary-level vertebrae. Exterior to the balsa wood would lie the exterior portion of the link in a shape consistent with accommodating standardized computer cable connectors (such as RS-232C DB25 male). This part of the link could be composed of either hardwood, for interior environments, or plastic-type material more suitable for exterior environments.

Such a novel design for data communications cable brings with it numerous performance advantages beyond the current art as derived directly from the principals set forth by the audio cable example including but not limited to exceptional power efficiency, tremendous speed (a critical factor in data communication applications), and a cleaner signal profile. Furthermore, such a cable configuration could be utilized for electro-optic applications. Some of the electromagnetic parameters of the cable set forth in the audio cable example may not play a large role in an electro-optic application. However, the vertebrae structure would provide great mechanical strength and flexibility for electro-optic applications. Indeed, the ability to provide a stable mechanical and thermal environment is a very desirable factor for electro-optic cable. Such performance is a natural consequence of the vertebrae design. Furthermore, in a miniaturized version of the vertebrae design, interferometric, reflective, refractive and other optical effects could be readily utilized.

Figure 15:
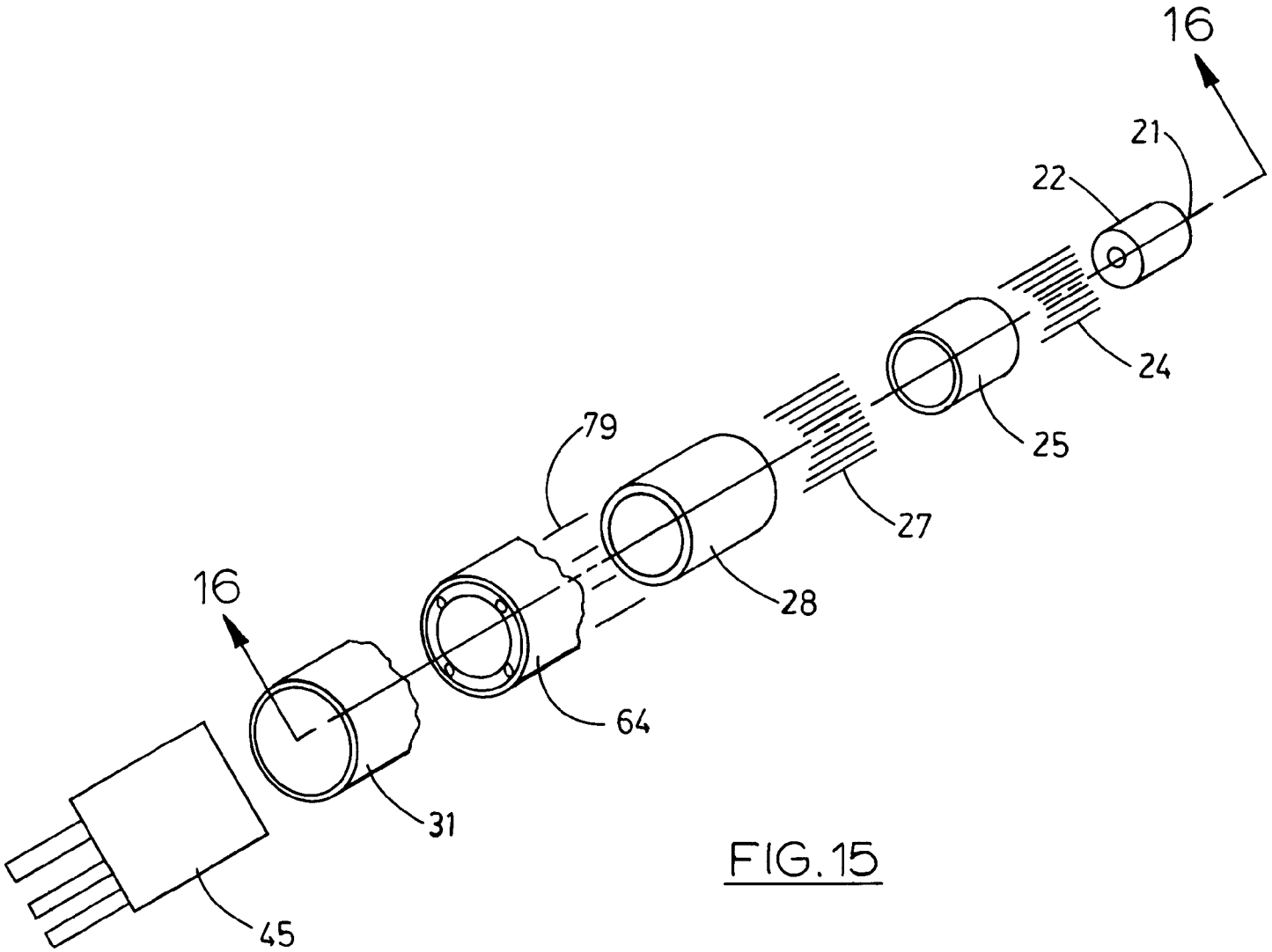
FIG. 15 is an exploded view of a cable of the present invention adapted for use as a power or robotics cable or with robotics.

Another application of the invention would be for power and robotics cable. FIG. 15 shows an exploded view of a power/robotics cable. Much of the cable depicted here is very similar to the audio cable example. One major difference is the utilization of additional structural components such as exterior structural wires 79 and accompanying exterior structural vertebrae which house or position the exterior structural wires. The utilization of corrosion resistive polycarbonate material and/or high tensile strength metal material 64 for the exterior casing for use in marine or other extreme environmental conditions is another variation suitable for power/robotics applications. Indeed, additional environmentally resistant or structurally supportive layers of vertebrae at any level within the cable would be common for such applications. Another variation typical to this class of cable would be an increase in gap length and utilization of lightweight materials in conjunction with the lightweight balsa wood vertebrae for use in aeronautic and/or aerospace applications. Indeed, the high strength to weight ratio of the present invention is one of its mechanical novelties.

Figure 16:
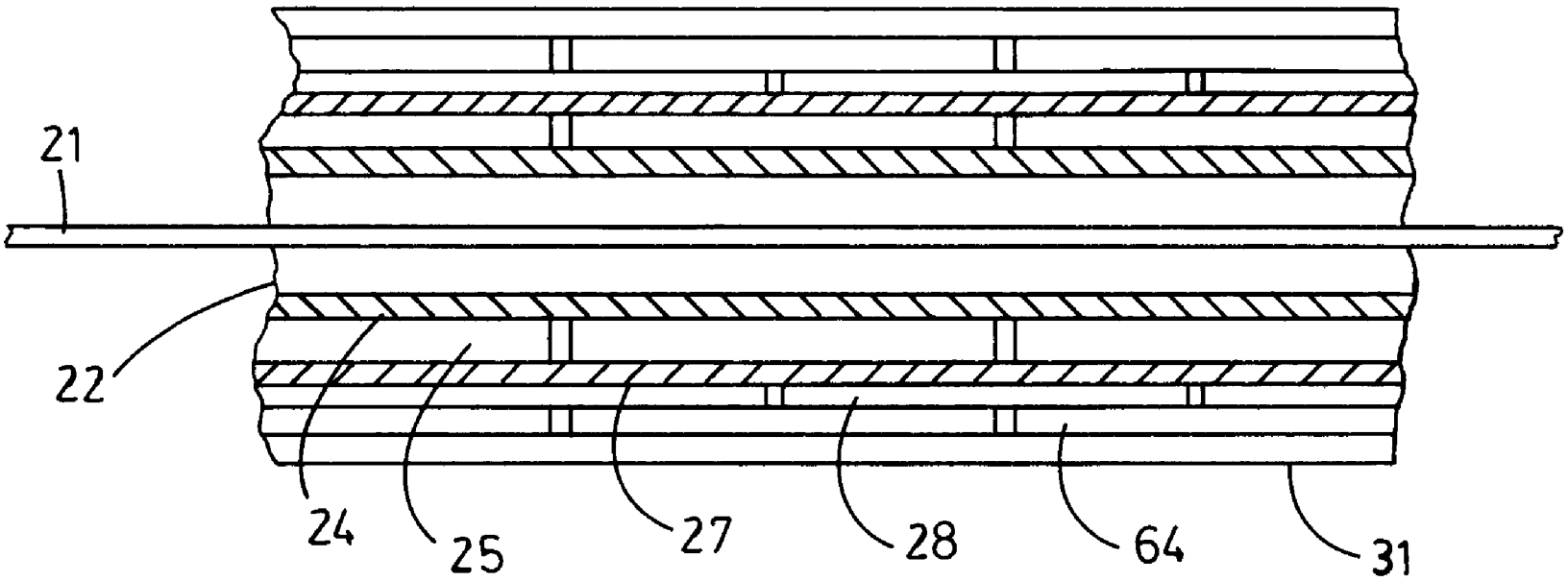
FIG. 16 is a cut away side view of a cable of the present invention along line 16—16 of FIG. 15.

Also of great significance for power/robotics applications is the ability to arrange layers of vertebrae in various configurations to add strength, provide flexibility and define bending radii. To this end, arranging vertebrae with alternating lengths and gaps (like building a brick wall) provides unprecedented strength, light weight and flexibility to power and robotics cable. FIG. 16 is a longitudinal sectional view of the cable depicted in FIG. 15 and demonstrates how a typical layering of vertebrae might be arranged in a power/robotics application.

Figure 17:
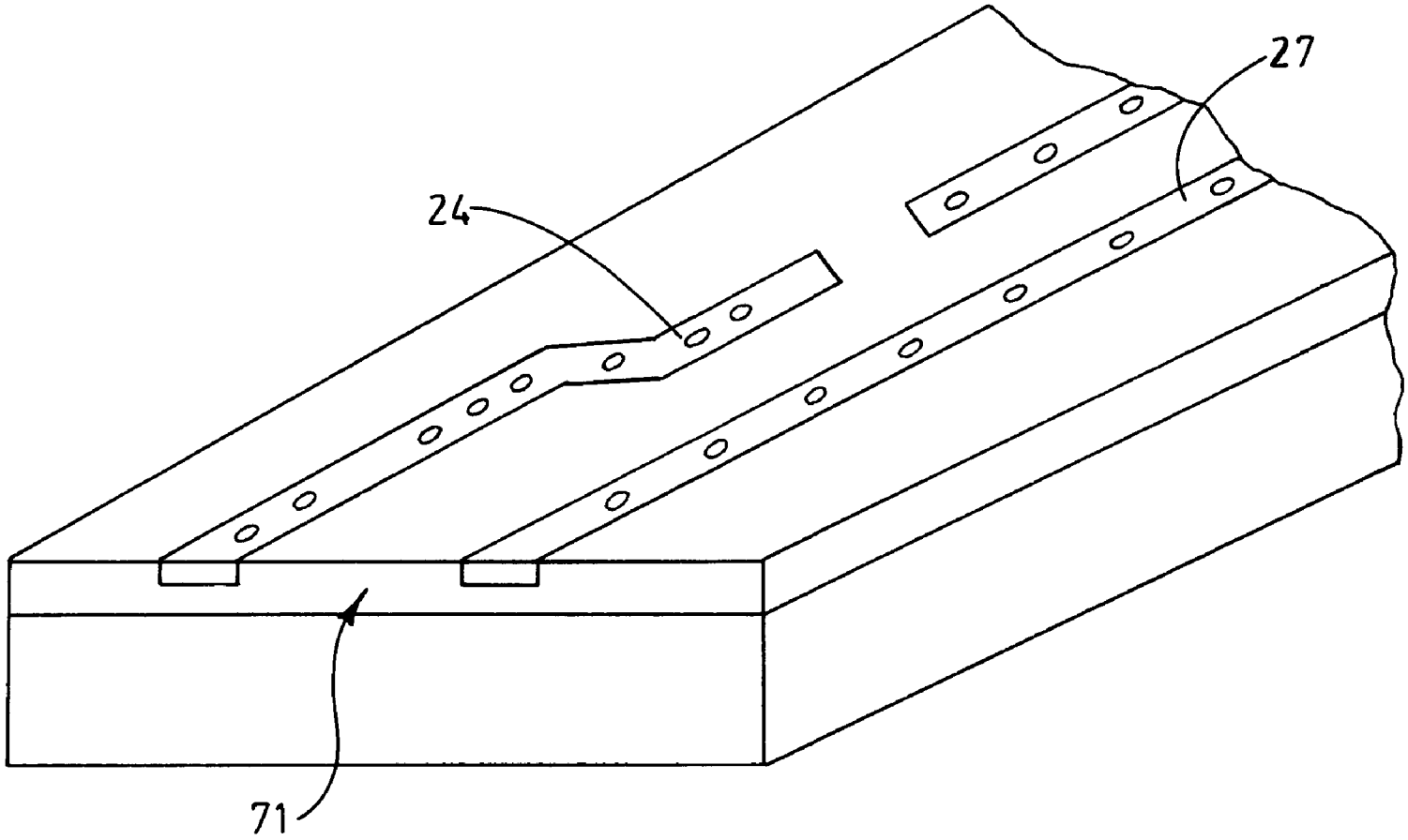
FIG. 17 is a perspective view of the cable of the present invention adapted for use in a printed circuit board.

Another application of the present invention is the use of the balsa wood 71 as insulation material and the particular arrangement of current conducting devices (stranded wires solid wire, solid metal strips, semiconductive material, etc.) in preconfigured patterns as would be typical for printed circuit boards 72. FIG. 17 shows a typical configuration. Such an arrangement is in effect the miniaturization of the cable and reconfiguring of its cylindrical shape into a geometry suitable for use in printed circuit board applications. The numerous performance advantages of the present invention in its cylindrical cable format, such as a low overall dielectric, high speed and low power consumption, are all manifested in the printed circuit board variation. Indeed, the geometric shape of the cable is not of critical importance so long as its geometry does not defeat the novel electromagnetic features of the present invention. To that end, cable of a cylindrical, flat, rectangular, elliptical or other shape are well within the scope of the present invention.

DESCRIPTION OF THE PREFERRED EMBODIMENTS

In the preferred embodiment of FIGS. 5–9 and 12, an audio cable application is presented. The mechanical guide wire assembly 21 consists of strands of wire twisted together longitudinally between the total length of all the interior vertebrae 22. The mechanical guide wire assembly is threaded through a cylindrical channel positioned in the center of each interior vertebrae 22. The diameter of this cylindrical channel is designed to provide a snug slip fit clearance between the mechanical guide wire assembly and the cylindrical channel of the internal vertebrae that is tight enough to prevent the build up of excessive resonances and loss of dampening indicative of looser fits between conductive and insulating material. Conversely, the gap, although snug, allows enough space for easy assembly and adds to the overall flexibility of the cable.

In the preferred embodiment, all of the vertebrae 22, 25, 28 and 32 are fabricated from balsa wood and of an approximately equal length. However, the length of the vertebrae is not a fixed parameter but depends on the application involved. Said lengths are determined by such design parameters as the bending radius of the cable as well electrical performance characteristics (such as resonance reduction; itself a function of the frequency passband of the signal passing through the cable). A typical audio application would utilize a vertebrae length of about 0.5 inches.

In the preferred embodiment, all of the gaps between the vertebrae 23, 26, 29 and 34 are approximately the same width. However, the lengths of the gaps are also not a fixed parameter but depend on the application involved. Said lengths are determined by such design parameters as the bending radius of the cable as well as electrical performance characteristics (such as resonance reduction; itself a function of the frequency passband of the signal passing through the cable). A typical audio application would utilize a vertebrae gap length of about 0.04 inches.

Flexible material 37, when applicable, is only provided between vertebrae 22 and is preferably a self-curing, flexible, silicon compound. The outer diameter of this material 37 should extend no more than approximately eighty percent (80%) of the outer diameter of the internal vertebrae 22. Unique to this invention is the utilization of balsa wood which has an extremely low dielectric factor yet is stiff and provides flexibility by the continuous, longitudinal assembly of component vertebrae, with a specified uniform gap between each, the sum of which determines the length of the cable.

The interior anode 27 may be comprised of strands of wire, or the like, preferably but not necessarily in 40-strand groups. Anode wire 27 should be helically wound around the internal vertebrae 22 preferably in a clockwise direction between the ends of the internal vertebrae assembly.

The outer diameter of each secondary-level vertebrae 25 is equal to all other secondary-level vertebrae. Each secondary-level vertebrae has a radially centered internal cylindrical channel, designed to accommodate the interior vertebrae/inner anode assembly. There is no silicon or any other material within the gaps between the secondary-level vertebrae.

The cathode may be comprised of strands of wire, or the like, preferably but not necessarily in 80-strand groups. Cathode wire 24 should be helically wound around the secondary level vertebrae assembly 25, preferably in a counterclockwise direction between the ends of the secondary-level vertebrae assembly, but in any event in an opposite direction of the wind of the anode wires.

The outer diameter of each tertiary-level vertebrae 32 is equal to all other tertiary-level vertebrae. Each tertiary-level vertebrae has a radially centered internal cylindrical channel designed to accommodate the secondary-level vertebrae/cathode assembly.

The exterior anode 33 may be comprised of any number of strands of wire. The sum total of the anode wires 27 and 33 may be the same as the cathode wires 24. Anode wires 33 should be helically wound around the mid-level vertebrae 32 in the same direction as anode wires 27 (preferably clockwise), and in the opposite direction as the cathode wires 24, between the ends of the internal vertebrae assembly.

The outer diameter of each exterior vertebrae 28 is equal to all other exterior vertebrae. Each exterior vertebrae has a radially centered cylindrical channel designed to accommodate the tertiary-level vertebrae/exterior anode assembly.

At the ends of the cable, the plurality of wires of the external anode 33 and the interior anode 27 are twisted together in the same direction (preferably clockwise) as they were helically wound inside the cable, and in a direction opposite of the winding of cathode 24. Similarly, the plurality of wires of the cathode 24 are twisted in the opposite direction as the anode wires (e.g. counterclockwise) beginning at the outside ends of the vertebrae and continuing outward to the end of the cathode.

Encasing the exterior vertebrae is an exterior absorption casing 30, preferably but not necessary, composed of cast and cured cylinder of flexible silicon, that is longitudinally disposed between the ends of the vertebrae assembly. The thickness of this absorption casing is dependent on the application and is driven by its function as an electrical current resonance absorption device; where said resonance itself is a function of the frequency passband of the signal passing through the cable. For an audio cable application, a typical thickness would be about 0.05 inches.

Figure 10:
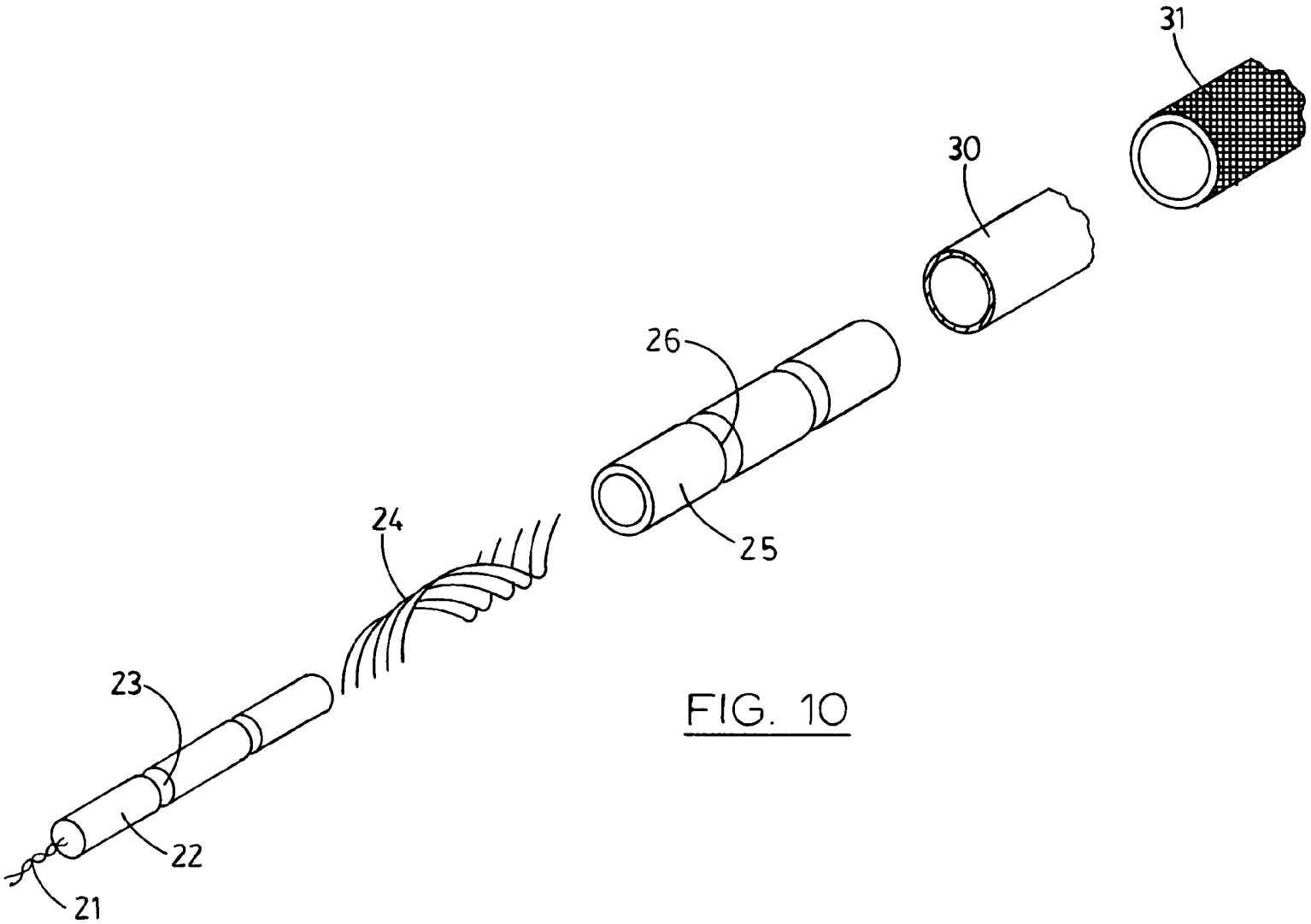
FIG. 10 is an exploded view of a single conductor anode and single conductor cathode version of the cable of the present invention using the guide "wire" as a conductor.
Figure 11:
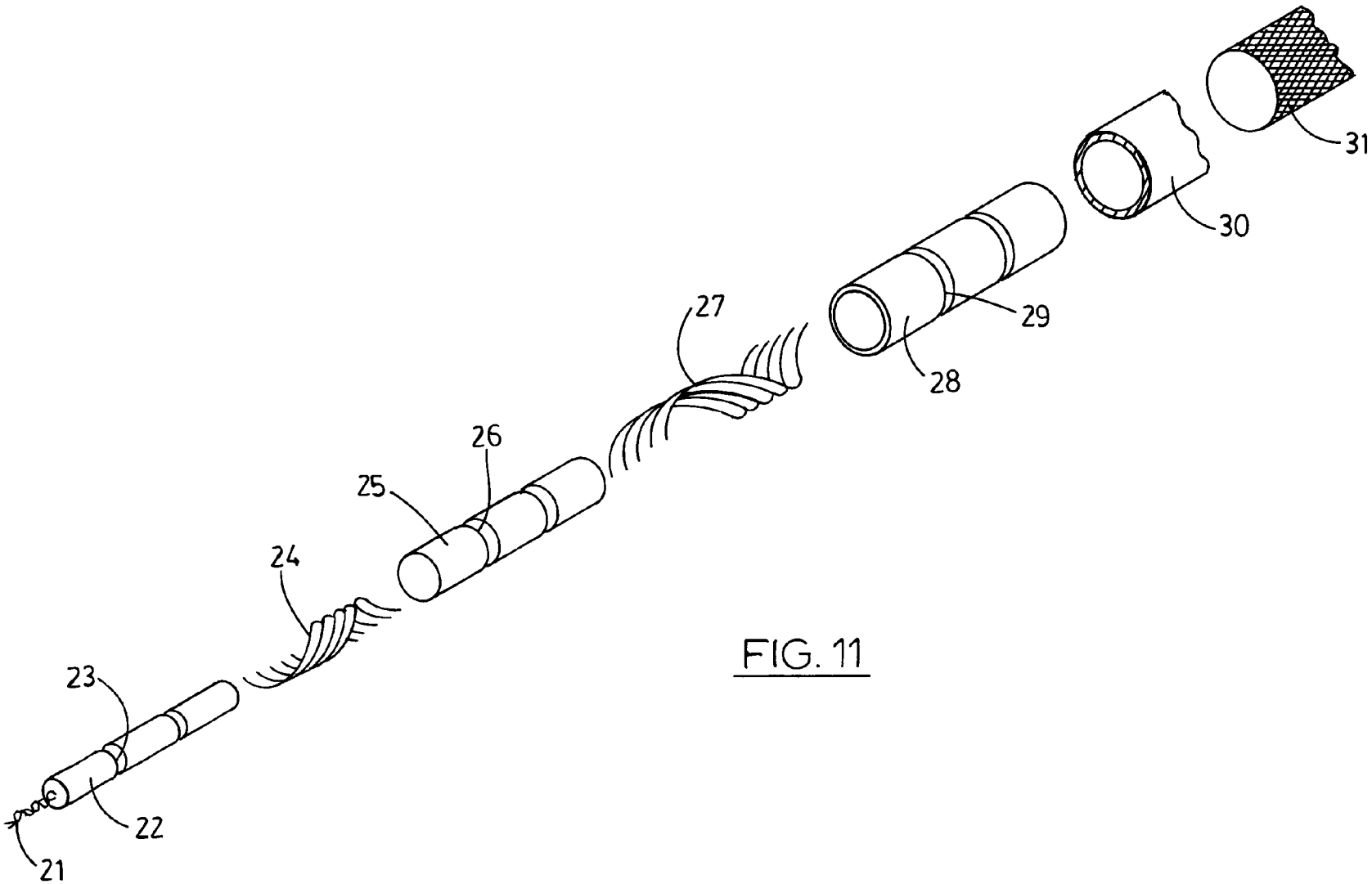
FIG. 11 is an exploded view of a single conductor anode and single conductor cathode version of the cable of the present invention.
Figure 12:
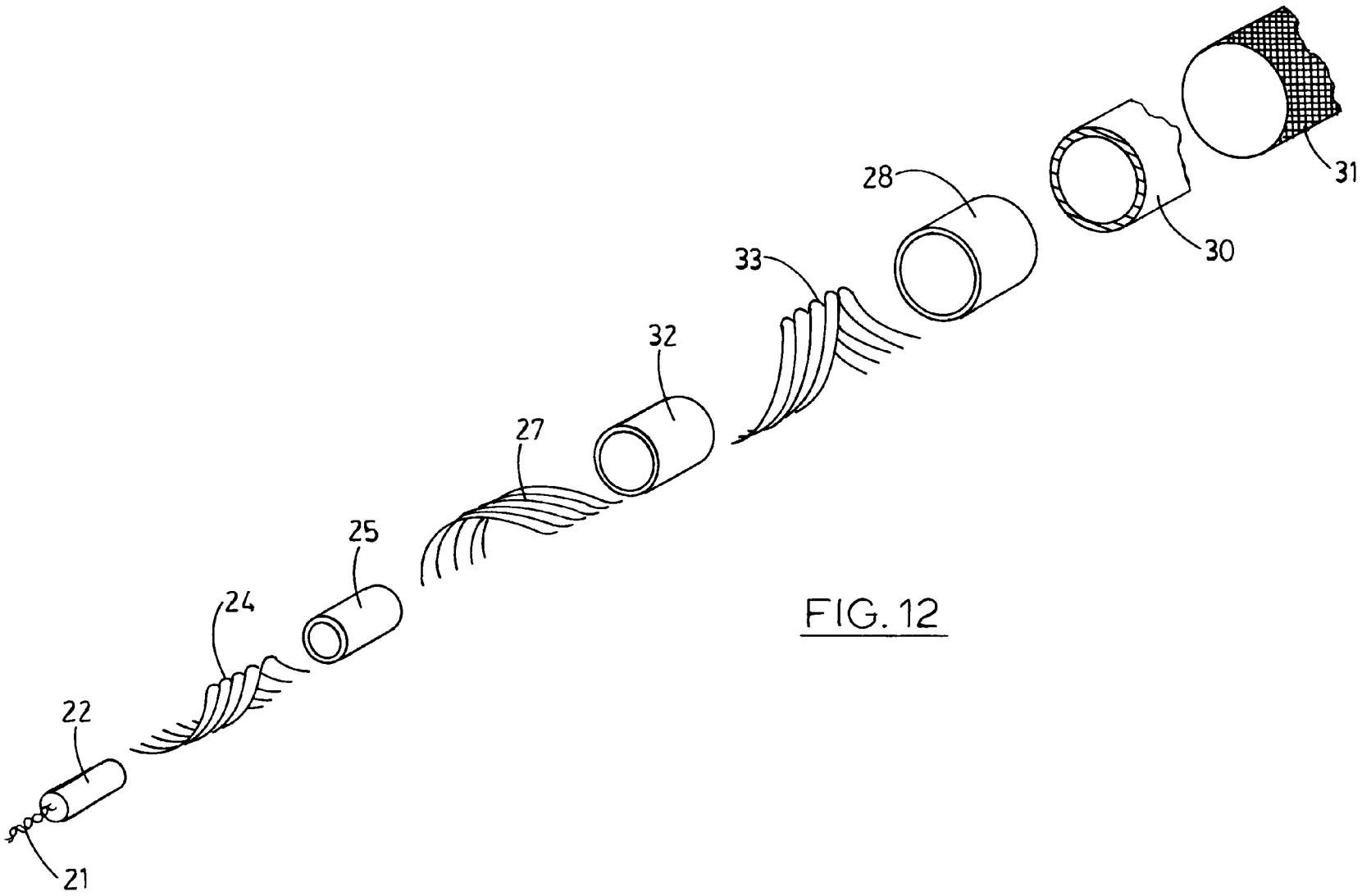
FIG. 12 is an exploded view of a dual conductor anode and single conductor cathode version of the cable of the present invention.

Unique to this invention is the lack of contact of this silicon with any conductor except in FIG. 10 where the silicon comes in contact only with the anode. It is unique that silicon does not make contact with any or both conductors. Also very unique to this invention is that this silicon casing serves to absorb such internal resonances from the internal assemblies which are caused by the passing of electrons through the conductors. However, novel to this invention is the effect of a very low resonance due to the extremely low inductive reactance of the cable. The reasons for this extremely low inductive reactance is extremely low resistance. Such low resistance is the consequence of a accumulation of novel design parameters unique to this invention including low seepage of electrons through the insulating vertebrae; the use of multiple strands of each strand is insulated with a very thin, low dielectric polymer coating; the lack of the proximity effect due to single layer concentric geometry of the conductors, the lack of the skin effect due to the small diameter of the individual strands of wire, the extremely low overall inductance of the cable. Exterior to this absorption casing lie the exterior casings.

The type of material used and the number of exterior casings employed depends on the application. Such casing may vary from a single casing composed of a simple nylon mesh (as would be used in audio cable designed for indoor, home use) to a series of casings composed of impact and corrosion resistant thermoplastic resin compounds integrated with metal compounds with high structural strength characteristics (as would be used in outdoor or marine environments where the cable could be subjected to high mechanical stress).

At each end of the cable are the cable links which serve as a bridge to connect the anode and cathode to a variety of standardized or novel electrical and/or electro-optic connectors. In addition, the links serve as a means to mechanically terminate and stabilize the cable. Since the variety of connectors in the art is extensive, specifying a particular arrangement for the link is not practical. The purpose of the link is to maintain the performance benefits unique to this invention while providing a means to make a practical connection to connection components common to the art (such as plugs, jacks and spades). To that end, the interior portion of the link is composed of balsa wood arranged in such a way that the wires passing through the link are sufficiently isolated from each other as is required for the application involved. In accord with the spirit of the invention, use of adhesive material is kept to a minimum and for the most part only balsa wood and air are the only compounds touching the wires. Thus, the low dielectric inherent of the cable proper is maintained.

Lying exterior to the interior portion of the link is the exterior link casing. Such material may vary depending on the application involved (ranging from a PVC-type casing for data transmission applications to corrosive resistant thermoplastic resin compounds for marine applications). Unique to this invention is the use of hardwoods (such as cocobolo, ebony, tulipwood, rosewood, mahogany, maple, etc.) as an exterior link casing material for cable designed for indoor use. The dielectric of hardwoods as a class is low, although not as low as balsa. This in turn maintains a high overall efficiency which results in the cable's low power consumption and high speed characteristics. Furthermore, the aesthetic appeal of hardwoods makes its use in electric and/or electro-optic cable a novel feature; one that is quite distinctive and appealing in the audiophile market.

Those skilled in the art will also appreciate that various options such as a single-ended interconnect with cast OFC RCA connectors, or a (balanced-line) interconnect with OFC XLR connectors are both available for extraordinary performance to match the full performance of the cable described in this invention. Also, very unique to this invention is the extremely low resistance of the cable resulting in a significant increase in efficiency. For an audio application, performance with more efficiency than the present art has been observed. Such performance in an audio cable will allow the driving of amplification equipment at elevated power levels heretofore unobtainable by current art while displaying an unprecedented amount of control and detail over the entire audio spectrum.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. An electronically conductive cable comprising a removable central guide wire surrounded by a first plurality of longitudinal cylindrical vertebrae made of low dielectric material such that adjacent vertebrae touch against each other without any gaps, at least one first electrically conductive wire helically wrapped around said first vertebrae, a second plurality of longitudinal cylindrical vertebrae made of low dielectric material surrounding said first helically wrapped wire such that adjacent second vertebrae touch against each other without any gaps, at least one second electrically conductive wire helically wrapped around said second vertebrae, and a third plurality of longitudinal cylindrical vertebrae made of low dielectric material surrounding said second helically wrapped wire such that adjacent third vertebrae touch against each other without any gaps, and a sealed cylindrical exterior casing.

2. The cable described in claim 1 wherein the wrap of said second helically wrapped wire is in the opposite direction from the wrap of the first helically wrapped wire.

3. The cable described in claim 1 wherein said guide wire and said second helically wrapped wire are conductively associated with each other.

4. An electronically conductive cable comprising a removable central guide wire surrounded by a first plurality of longitudinal cylindrical vertebrae made of low dielectric material, said first vertebrae being separated from each other by a plurality of gaps of approximately equal size, at least one first electrically conductive wire helically wrapped around said first vertebrae, a second plurality of longitudinal cylindrical vertebrae made of low dielectric material surrounding said first helically wrapped wire, said second vertebrae also being separated from each other by a second plurality of gaps of approximately equal size, and a sealed cylindrical exterior casing, wherein at least one second electrically conductive wire is helically wrapped around said second vertebrae, and a third plurality of longitudinal cylindrical vertebrae made of low dielectric material is provided surrounding said second helically wrapped wire, said third vertebrae also being separated from each other by a third plurality of gaps of approximately equal size.

* * * * *